US005755587A

United States Patent [19]

Sakai et al.

[11] Patent Number: 5,755,587

[45] Date of Patent: May 26, 1998

[54] CONNECTOR WITH ENGAGEMENT CONFIRMING MECHANISM

[75] Inventors: Hitoshi Sakai; Kazuto Ohtaka, both of Shizuoka, Japan

[73] Assignee: Yazaki Corporation, Tokyo, Japan

[21] Appl. No.: 732,667

[22] Filed: Oct. 16, 1996

[30] Foreign Application Priority Data

Oct. 18, 1995 [JP] Japan ..... 7-269691

[51] Int. Cl.[6] ..... H01R 13/627

[52] U.S. Cl. ..... 439/352; 439/489

[58] Field of Search ..... 439/352, 353, 439/354, 488, 489

[56] References Cited

U.S. PATENT DOCUMENTS 5,234,356 8/1993 Maejima et al. ..... 439/352
5,605,472 2/1997 Sakai et al. ..... 439/489

FOREIGN PATENT DOCUMENTS 3-285280 12/1991 Japan .
8-31517 2/1996 Japan .

*Primary Examiner*—Gary F. Paumen
*Assistant Examiner*—Yong Ki Kim
*Attorney, Agent, or Firm*—Armstrong, Westerman Hattori, McLeland & Naughton

[57] ABSTRACT

A connector includes a first connector housing having a resiliently deflectable lock arm in an outer wall of the first connector housing and a second connector housing having a lock arm engaging with a locking piece fitted in the first connector housing. In the complete engaged state of the pair of connector housings, the lock arm engages with the locking piece so that the first and second connector housings are secured to each other. The connector further includes an engagement confirming member movably attached to the lock arm and an engagement retaining wall standing and positioned adjacently to the engagement confirming member. In the complete engagement of the pair of connector housings, the engagement confirming member is moved onto a top portion of the engagement retaining wall to prevent the lock arm from deflecting. The engagement confirming member is preferably attached movably in a substantially orthogonal direction to the engagement direction of the connector housings.

5 Claims, 3 Drawing Sheets

CONNECTOR WITH ENGAGEMENT CONFIRMING MECHANISM

BACKGROUND OF THE INVENTION

1. Field of the Invention

This invention relates to a connector with an engagement confirming mechanism, which is utilized generally for electric wiring in automobiles.

2. Description of the Prior Art As a conventional connector equipped with an engagement confirming mechanism, for example, Japanese Patent Application Laid-open No. H. 3-285280 discloses a connector K shown in FIG. 7.

The connector K has a pair of male and female connector housings a, b. The first connector housing a is provided with a lock arm c in which a lock confirming slide member s having a lock confirming arm d is detachably mounted.

The lock confirming slide member s is detachably mounted into a passage e formed in the lock arm c in the engagement direction of the connector housings a, b.

In an engaging step of the connector housings a, b, when the lock arm c has been unlocked, as shown in FIG. 8, a stopper f of the lock confirming arm d inserted into the passage e abuts against a locking projection g of the lock arm c. In the meantime, as the lock confirming arm d is held by the lock arm c. Thus, the lock confirming arm d can not advance any more in this state.

When the connector housings a, b have engaged with each other and the lock arm c has locked to the connector housing b, the stopper f has been released from the locking projection g. Accordingly, the lock confirming arm d can advance further so that the lock confirming slide member s can moved up to a lock confirming position for confirming a complete engagement of the connector housings a, b.

However, in the above mentioned structure of the connector K, the passage e is formed in the lock arm c in itself and the lock confirming slide member s is detachably mounted therein, which brings the drawback that the lock arm c can not be made smaller in breadth according to the breadth of the connector housing in the case that the connector housings accommodate only a few terminals. That is, a smaller structure of the connector K is restricted in breadth.

SUMMARY OF THE INVENTION

In view of the above-mentioned drawback, a subject of the present invention is to provide a connector equipped with an engagement confirming mechanism that can easily confirm a complete engaged state of mating connector housings and is suitable for miniaturization design of the connector housing particularly regarding connectors accommodating only a few terminals.

For achieving the subject, in the present invention, a connector includes a first connector housing having a resiliently deflectable lock arm in an outer wall of the first connector housing, a second connector housing having a lock arm engaging with a locking plate fitted in the first connector housing, wherein, in the complete engaged state of the pair of connector housings, the lock arm engages with the locking plate so that the first and second connector housings are secured to each other, an engagement confirming member movably attached to the lock arm, and an engagement retaining wall standing and positioned adjacently to the engagement confirming member, wherein, in the complete engagement of the pair of connector housings, the engagement confirming member is moved onto a top portion of the engagement retaining wall to prevent the lock arm from deflecting.

The engagement confirming member is preferably attached movably in a substantially orthogonal direction to the engagement direction of the pair of connector housings.

Preferably, a projecting plate portion is provided in a free end of the lock arm and the engagement confirming member is formed with a guide wall having a guide groove, the projecting plate portion inserted into the guide groove so that the engagement confirming member may be movable along the projecting plate portion.

Advantageously, a locking projection is provided in the guide wall of the engagement confirming member and the projecting plate portion is formed with a recess engaging with the locking projection.

DETAILED DESCRIPTION OF PREFERRED EMBODIMENTS

An embodiment of the present invention will be discussed in the following.

Figure 1:
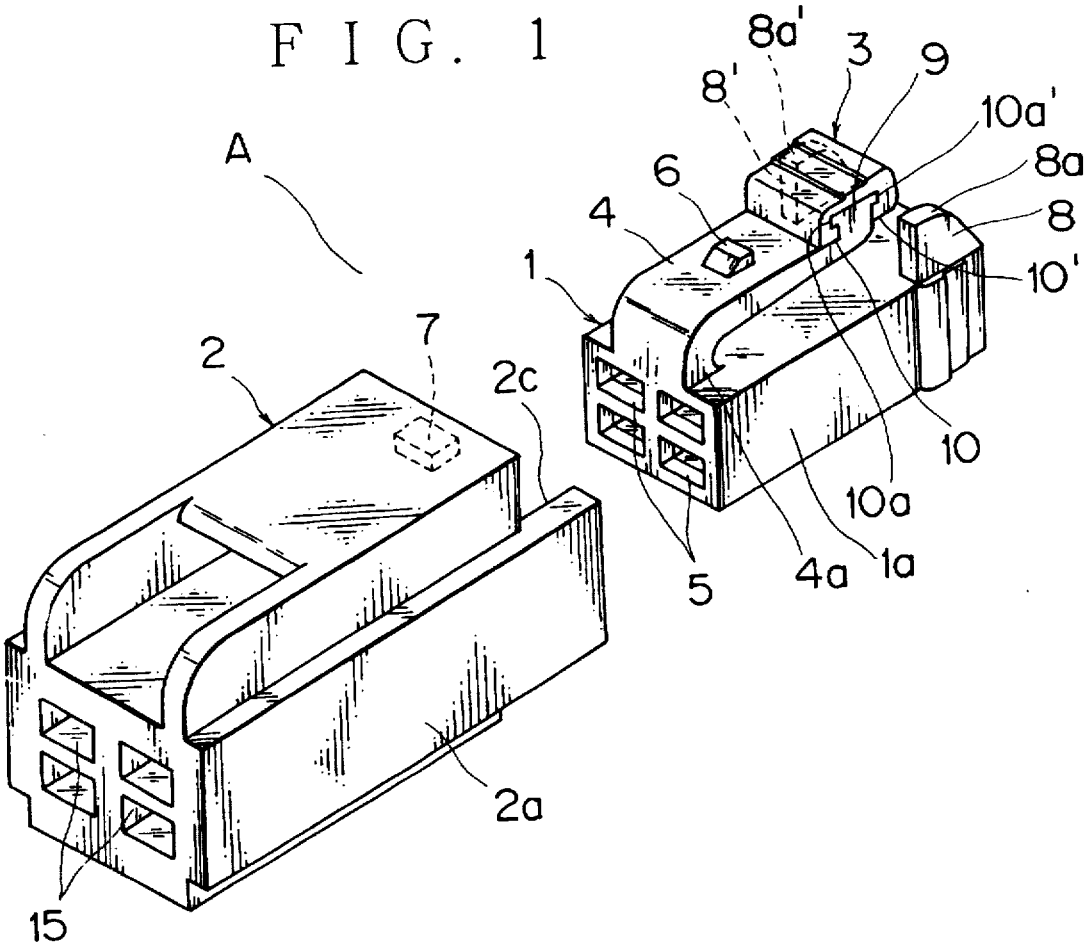
FIG. 1 is a perspective view showing a connector with an engagement confirming mechanism of an embodiment according to the invention.

FIG. 1 is a perspective view of a connector A equipped with an engagement confirming mechanism of an embodiment according to the invention.

The connector A consists of a pair of mutually mating connector housings 1, 2 and an engagement confirming member 9 slidably mounted in a lock arm 4 of a first connector housing 1.

Figure 2:
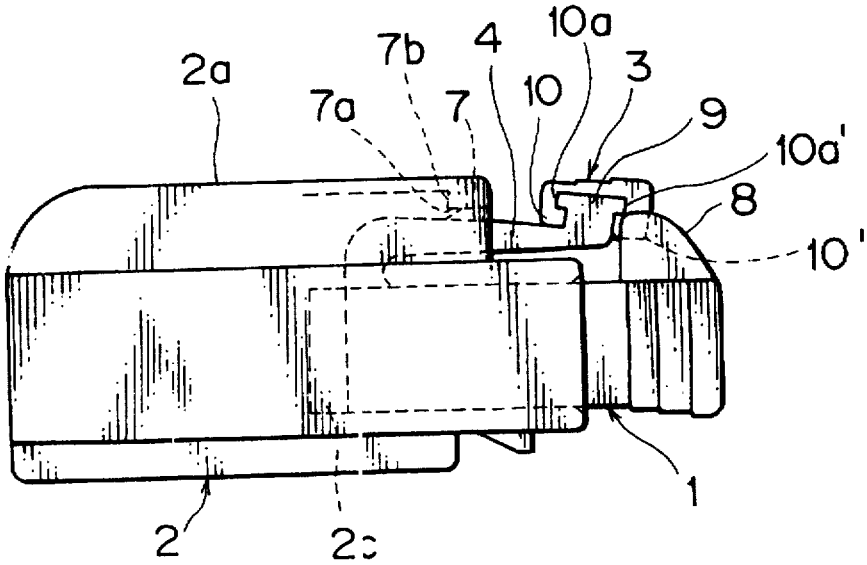
FIG. 2 is a side view showing a partially or halfway engaging state of connector housings in FIG. 1.

The first connector housing 1 has the lock arm 4 with a rising base 4*a* rising from an outer wall 1*a* of the housing 1 and is formed with terminal accommodating chambers 5 therein. In the middle of the lock arm 4, there is formed with a projecting locking hook 6. The hook 6, as shown in FIG. 2, engages with a locking plate 7 disposed inside of an outer wall 2*a* of a second connector housing 2 for locking the pair of connector housings 1, 2 to each other.

In the rear of the outer wall la, engagement retaining walls 8, 8' stand and are disposed such that the lock arm 4 is located between them.

On a free end of the lock arm 4, a projecting plate portion 9 with a T-shaped cross section is formed substantially orthogonally to the engagement direction of the pair of connector housings 1, 2. An engagement confirming member 3 is slidably attached to the projecting plate portion 9.

The engagement confirming member 3, at each side end thereof, is formed with resilient guide walls 10, 10' having guide grooves 10a, 10a' with a rectangular cross section. The projecting plate portion 9 is slidably inserted into the guide grooves 10a, 10a' of the lock arm 4.

The top portions 8a, 8a' of the engagement retaining walls 8, 8' standing in each side of the engagement confirming member 3 are a little lower than an outer periphery of the guide wall 10 of the engagement confirming member 3 attached to the lock arm 4.

Figure 3:
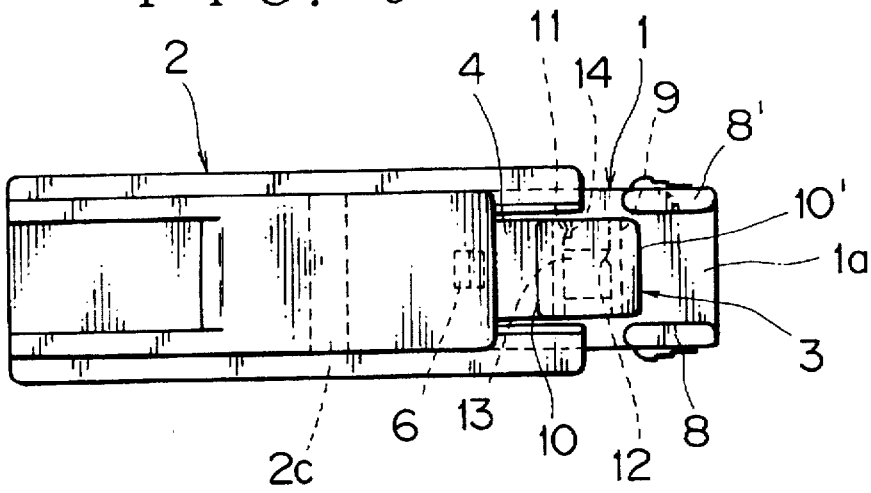
FIG. 3 is a top view of the pair of connector housings in FIG. 2.

The guide wall 10', as shown in FIG. 3, is provided with a locking projection 12 to limit an excessive movement of the engagement confirming member 3. The other guide wall 10 is also formed with a provisional locking projection 11 for provisionally stopping the engagement confirming member 3 in its middle position in cooperation with the locking projection 12, when the first connector housing 1 has not engaged with the second connector housing 2. Meanwhile, in the projecting plate portion 9 of the lock arm 4, there is formed with a recess 13 within which the locking projection 12 is allowed to move. Further, the projecting plate portion 9 is formed with a cut-out portion 14 for provisionally locking with the provisional locking projection 11 at an end portion of the projecting plate portion 9.

In the first connector housing 1 completely separated from the other connector housing, the locking projection 12 is positioned at one end of the recess 13 and the provisional locking projection 11 is positioned in the cut-out portion 14, which prevents the engagement confirming member 3 from falling off and keeps the engagement confirming member 3 in its middle position.

After the pair of connector housings 1, 2 have engaged to each other, the engagement confirming member 3 is moved onto the top portion 8a of the engagement retaining wall 8. Then, the provisional locking projection 11 of the resilient guide wall 10' rides over an edge of the cut-out portion 14 to move into the one end of the recess 13 and the locking projection 12 is positioned at the other end of the recess 13, which prevents the engagement confirming member 3 from unintentionally moving.

The second connector housing 2 has terminal accommodating chambers 15 therein. In an upper inside surface of the outer wall 2a, there is provided with a step-shaped locking plate 7 for locking the locking hook 6 of the lock arm 4.

The second connector housing 2, at one end thereof, has a receiving portion 2c extended from the outer wall 2a and receiving the opposing connector housing 1.

Next, operation of the engagement confirming member 3 in the engagement steps of the connector housing 1, 2 will be discussed in the following.

FIG. 2 and FIG. 3 show a half engaged state of the pair of connector housings 1 and 2, in which the first connector housing 1 has advanced into the receiving portion 2c of the second connector housing 2. Further, the locking hook 6 of the lock arm 4 has abutted against a projecting end 7a of the locking plate 7 of the second connector housing 2 so that the lock arm 4 has been forced to deflect downward.

By the downward deflection of the lock arm 4, the engagement confirming member 3 is lowered between the engagement retaining walls 8 and 8' and is prevented from moving above the engagement retaining walls 8, 8'.

Figure 4:
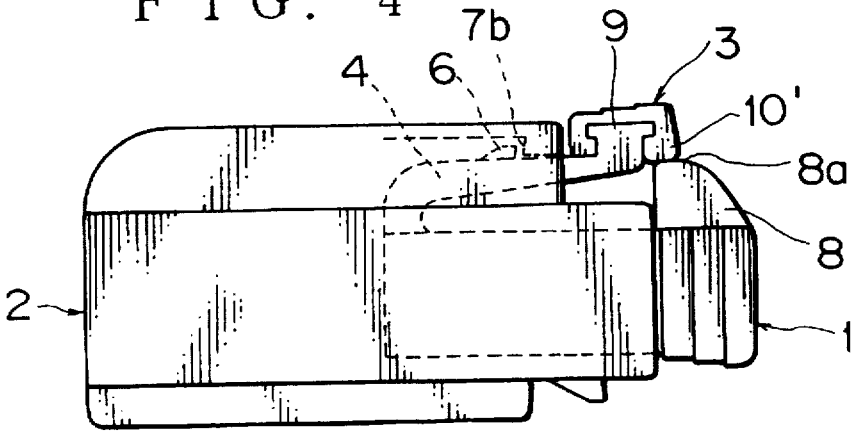
FIG. 4 is a side view showing a completely engaged state of state of the connector housings in FIG. 1.

When the pair of connector housings 1, 2 has completely engaged with each other and the lock arm 4 has advanced into the second connector housing 2, as shown in FIG. 4, the locking hook 6 has engaged to a step 7b of the locking plate 7. Thereby, the connector housings 1, 2 is locked to each other.

In the meantime, the resilient lock arm 4 has returned to its original position so that the engagement confirming member 3 can move over the top portion 8a of the engagement retaining wall 8. Then, a movement of the engagement confirming member 3 onto the engagement retaining wall 8 confirms the complete engaged state of the pair of connector housing 1, 2.

Figure 5:
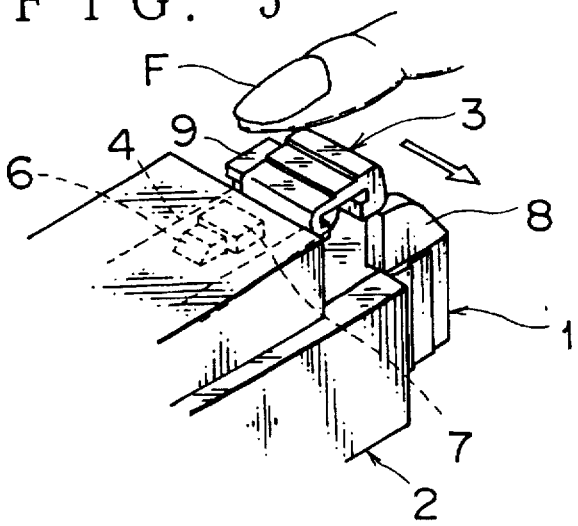
FIG. 5 is an explanatory illustration of an engagement confirming member shown in FIG. 4 and handled by a finger.
Figure 6:
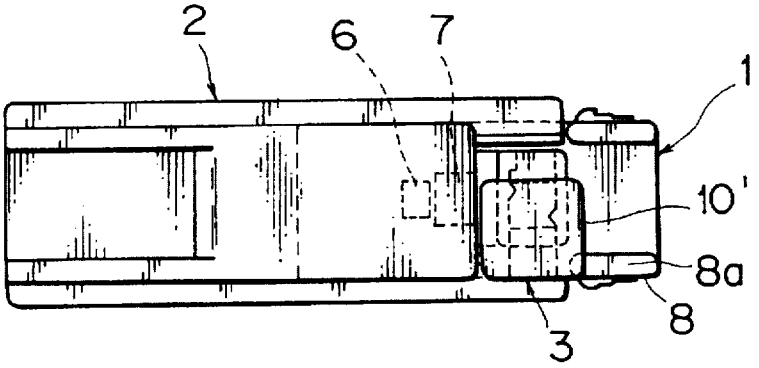
FIG. 6 is a top view showing the state that the engagement confirming member in FIG. 5 has moved onto an engagement retaining wall.
Figure 7:
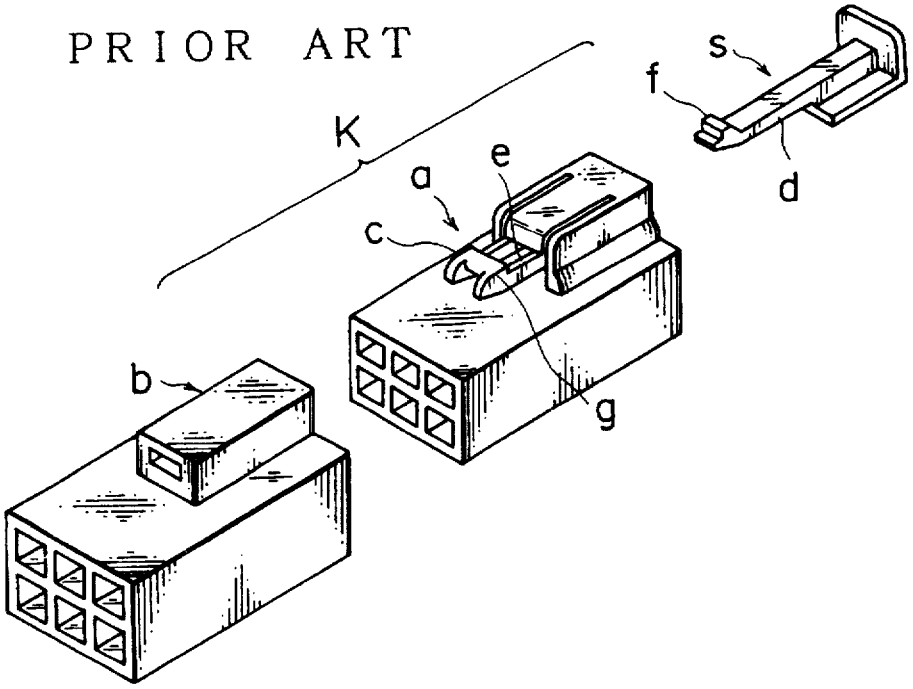
FIG. 7 PRIOR ART
FIG. 7 is a perspective view showing a connector with a conventional engagement confirming mechanism.
Figure 8:
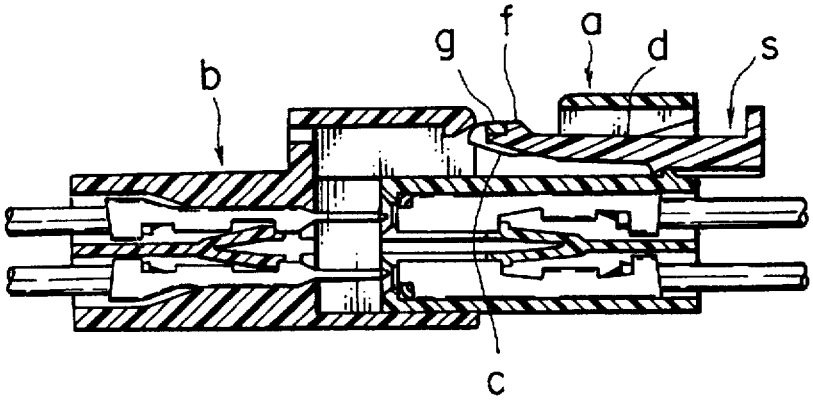
FIG. 8 PRIOR ART
FIG. 8 is a sectional view illustrating connector housings in FIG. 7 and showing a lock confirming slide member in relation of a lock arm in a halfway engaged state of the connector housings.

As shown in FIG. 5, a finger F moves the engagement confirming member 3 in an arrow head direction. As shown in FIG. 6, an end portion of a guide wall 10' of the engagement confirming member 3 is positioned on the top portion 8a of the engagement retaining wall 8. Thereby, the top portion 8a of the engagement retaining wall 8 abuts against the guide wall 10' of the engagement confirming member 3, which prevent the lock arm 4 from deflecting downward. The locking hook 6 engaged with the locking plate 7 of the second connector housing 2 prevents an upward motion of the lock arm 4. Further, the engagement confirming member 3 prevents a downward motion of the lock arm 4, which enables a secure lock of the connector housings.

Next, effects of the invention will discussed in the following.

In the invention, the lock arm of the first connector housing is movably provided with the engagement confirming member. Then, the engagement confirming member is moved on the engagement retaining wall, which prevents the lock arm from deflecting. This enables easily minimization of the engagement confirming member and its receiving space. That is, the connector housing is made smaller in breadth in comparison with the aforementioned conventional connector. Thus, a smaller and lightweight connector housing is enabled, which is suitable particularly for connectors accommodating only a few terminals.

Moreover, the invention offers the advantage that a smaller movement of the engagement confirming member accomplishes firm, stable locking of the connector housings and enables to confirm the engagement of the housings.

What is claimed is:

1. A connector with an engagement confirming mechanism comprising:

a first connector housing having a resiliently deflectable lock arm extending from an outer wall of said first connector housing and a locking hook projecting from said resiliently deflectable lock arm;

a second connector housing engageable with said first connector housing and having a locking plate engageable with said locking hook of said first connector housing, an engagement confirming member movably attached to said lock arm, wherein said engagement confirming member is attached movably in a substantially orthogonal direction to the engagement direction of said connector housings; and an engagement retaining wall extending from said outer wall of said first connector housing and positioned adjacent to said engagement confirming member, wherein, in the complete engagement of said connector housings, said engagement confirming member is movable above a top portion of said engagement retaining wall to prevent said lock arm from deflecting.

2. A connector with an engagement confirming mechanism according to claim 1, wherein a projecting plate portion is provided in a free end of said lock arm and said engagement confirming member is formed with a guide wall having a guide groove, said projecting plate portion inserted into said guide groove so that the engagement confirming member may be movable along said projecting plate portion.

3. A connector with an engagement confirming mechanism according to claim 2, wherein a locking projection is provided on said guide wall of said engagement confirming member and said projecting plate portion having a recess which is engageable with said locking projection.

4. A connector with an engagement confirming mechanism according to claim 3, wherein a provisional locking projection is provided in said guide wall of said engagement confirming member and said projecting plate portion having a cut-out portion which is provisionally engageable with said provisional locking projection.

5. A connector with an engagement confirming mechanism according to one of claims 1, 2, 3 or 4, wherein in a halfway engagement state of said first and second connector housings, said lock arm is deflected downward so that said engagement confirming member can not be movable above said top portion of said engagement retaining wall.

* * * * *